US005881749A

United States Patent [19]

Manser et al.

[11] Patent Number: 5,881,749

[45] Date of Patent: Mar. 16, 1999

[54] APPARATUS FOR CLEANING PASTA PRESSES

[75] Inventors: Josef Manser, Uzwil; Werner Seiler, Züberwangen; Heinz Resch, Flawil; Jürg Ebneter, St. Gallen, all of Switzerland

[73] Assignee: Bühler AG, Uzwil, Switzerland

[21] Appl. No.: 858,164

[22] Filed: Apr. 30, 1997

Related U.S. Application Data

[62] Division of Ser. No. 557,109, Dec. 1, 1995, Pat. No. 5,782,985.

[30] Foreign Application Priority Data

May 18, 1994 [DE] Germany ..... 44 17 357.1

[51] Int. Cl.[6] ..... B08B 3/02; B08B 9/00

[52] U.S. Cl. ..... 134/109; 100/145; 134/169 R

[58] Field of Search ..... 134/10, 22.11, 134/22.12, 25.2, 25.3, 109, 111, 110, 169 R; 425/226, 227; 100/112, 145; 99/353; 366/138

[56] References Cited

U.S. PATENT DOCUMENTS

| | | | |
|---|---|---|---|
| 2,818,076 | 12/1957 | Erling | 134/169 C X |
| 4,696,073 | 9/1987 | Urbania | 134/111 X |
| 5,156,861 | 10/1992 | Tsuchiya et al. | 425/225 |
| 5,281,374 | 1/1994 | Matsuda et al. | 264/39 |
| 5,392,797 | 2/1995 | Welch | 134/108 |

FOREIGN PATENT DOCUMENTS

| | | |
|---|---|---|
| 351423 | 11/1988 | European Pat. Off. . |
| 2332793 | 6/1977 | France . |
| 2468416 | 5/1981 | France . |
| 1024/93 | 9/1993 | Switzerland . |

OTHER PUBLICATIONS

Patent Abstracts of Japan vol. 18, No. 86 (C–1165) Feb. 14, 1994 & JP,A,05 292 933 (Japan Steel) Nov. 9, 93 (see abstract).

Patent Abstracts of Japan vol. 10, No. 269 (C–372) (2325) Sep. 12, 1986 & JP,A,61 093 820 (Sumitomo) May 12, 1986 see Abstract.

*Primary Examiner*—Philip R. Coe
*Attorney, Agent, or Firm*—Martin A. Farber

[57] ABSTRACT

An apparatus for cleaning pasta presses, particularly for the "in situ" cleaning of the screws of screw-type machines, kneader mixers and the like in the pasta industry.

This is effected without dismantling the machine by conveying cleaning liquids through the screw-type machines which are closed in liquid-tight manner. The cleaning liquids are preferably recycled and filtered.

6 Claims, 2 Drawing Sheets

APPARATUS FOR CLEANING PASTA PRESSES

RELATED APPLICATION

This application is a division of our application Ser. No. 08/557,109 filed Dec. 1, 1995, and now U.S. Pat. No. 5,782,985.

FIELD AND BACKGROUND OF THE INVENTION

The invention relates to an apparatus for cleaning pasta presses, particularly for the cleaning in place of the screws of screw-type machines, kneader mixers and the like in the pasta industry, by a treatment with water, lyes and acids.

In the modern pasta industry, moistened doughs are treated with pressing and kneading screws in screw-type machines, in order to build up, with the formation of the dough, a glutinous structure and simultaneously to build up a high pressure for the moulding. Thus EP-B-351423, for example, describes a process and an installation for producing dough for pasta, wherein the installation comprises a double-shaft kneader having two shafts turning in the same direction which are, to a high extent, self-cleaning. A single-shaft press screw is employed for building up the pressing pressure. The double-shaft kneader and the single-shaft machine can be directly connected to each other, in order to prevent both an unwanted pressure build-up in the kneader and contamination due to external influences. However, despite the extensive self-cleaning of the double-shaft kneader, a high expenditure of manual labor is necessary in order to achieve satisfactory cleaning of the single- and double-shaft machines when the product is changed or for preventive cleaning. Dismantling is necessary, with subsequent cleaning (water and cleansing agent) and re-assembly.

Swiss Patent Application No. 1024/93, which has not previously been published, offers a partial approach to the solution of this problem. According to the invention, screws can be automatically ejected from screw-type machines in one stroke, and in a further development the single-shaft screw press is connected to a swivelling double-shaft kneader. Due to the swivelling capability of the double-shaft kneader, cleaning of the latter and of the connection zones to the screw press is possible in principle. However, with the exception of the screw ejection, the manner in which this is to be effected is neither disclosed nor evident.

SUMMARY OF THE INVENTION

The object of the present invention is to eliminate the above indicated disadvantages of the known prior art and to achieve in situ cleaning of pasta presses or screw-type machines ("clean in place") without dismantling them. According to the invention the apparatus comprises a tank (7) provided with a filter which is connected to a high-pressure pump (8), wherein the connection between the tank (7) and a screw-type machine to be cleaned is effected by means of lines (6, 10) with the inclusion of the high-pressure pump (8), and the tank (7) is connected to a spray lance (13) by means of a line and the tank (7) is connected to an effluent treatment. Further according to the invention the cleaning liquid is conducted into screw presses (2) and/or kneader mixers (1) which are closed in liquid-tight manner and is discharged with adhering contaminants.

The application of the invention results in an antiseptic cleaning at low cost.

BRIEF DESCRIPTION OF THE DRAWINGS

With the above and other advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
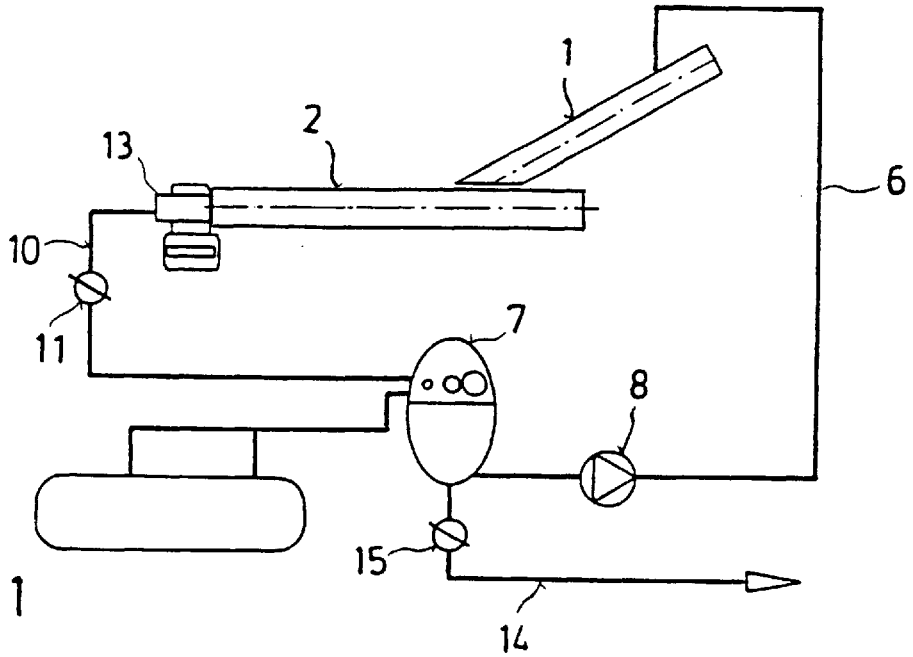
FIG. 1 a flow diagram according to the invention.

The cleaning of a kneader mixer 1 in the form of a double-shaft kneader and of a screw press 2 in the form of a single-shaft screw-press, without dismantling, commences, after interruption of their operation, with the swinging out of the kneader mixer 1 (FIG. 3) and sealing the outlet opening 3 by a closure 4. Thereafter, firstly cold water under pressure and then hot water under pressure are supplied from a tank 7, via connection pieces 5 and lines 6, by means of a high-pressure pump 8. Soaking/softening of adhering pasta residue on the inside walls of the kneader mixer 1 and of the shaft(s) 9 is effected over a period of one to two hours. Flushing is then effected until the desired degree of cleanliness is achieved. This is followed by treatment with lye and by neutralization by means of suitable acids.

The connection pieces 5 may also be provided with high-pressure nozzles in order to accomplish cleaning of the kneader mixer 1 after a treatment duration of only about 10 minutes.

In such case, it is of course to be understood that the kneader mixer 1 and the screw press 2 must be made of highly corrosion-resistant materials, including bronze alloys.

Cleaning of the screw press 2 is effected separately from the above, but in an analogous manner, wherein after the swinging out of a head piece 12 of the screw press 2 a spray lance 13 is fitted in its place. The supply of water, lye and acid is effected in the aforementioned sequence, again from the tank 7, via a line 10 which is provided with a shut-off valve 11.

Cleaning of the head piece 12 is performed separately.

Figure 2:
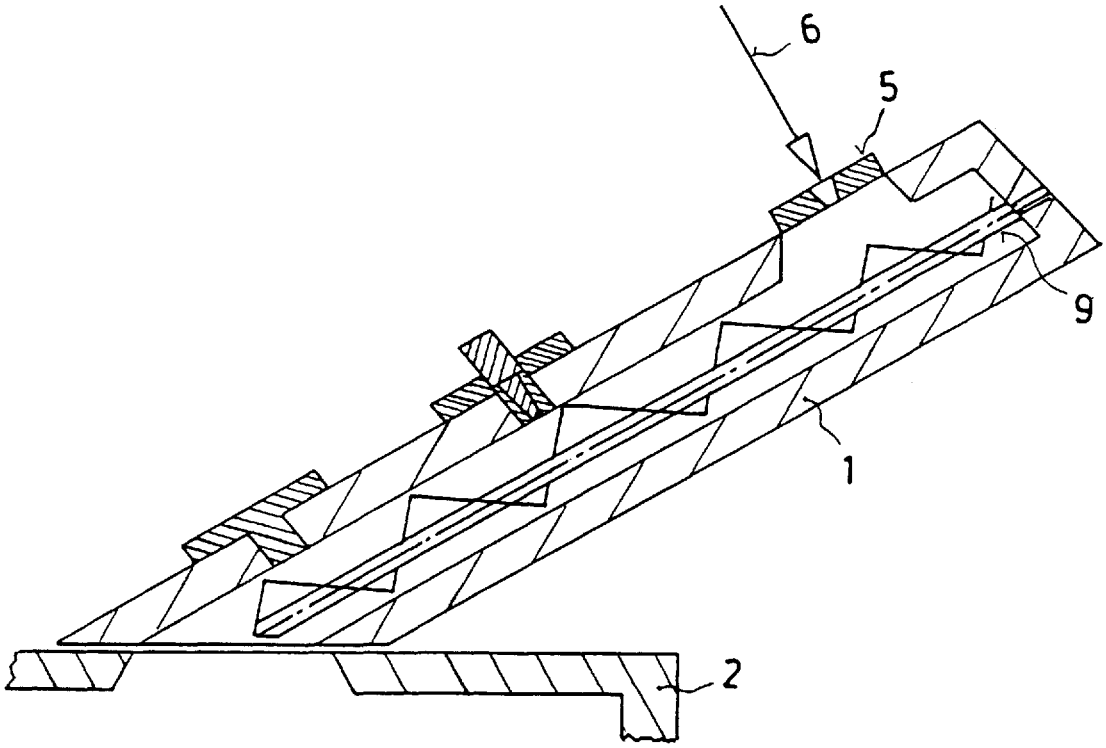
FIG. 2 a portion of FIG. 1.

In order to improve the cleaning effect and to obtain closed circuits, the kneader mixer 1 is connected to the screw press in their operating position (FIGS. 2 and 3) and water and/or cleansing agent are pumped in the manner described into the kneader mixer 1 and the screw press 2 from the tank 7 by means of the high pressure pump 8 via lines 6 and 10, respectively. The spray lance 13 is designed for both directions of flow. The process liquid flowing back via lines 6 and 10, respectively, is filtered in the tank 7 and recycled. Filter residues and effluent liquid are fed via a line 14 and a shut-off valve 15 to a customary clarification plant.

It is also possible to effect unpressurized cleaning with or without the inclusion of the high pressure pump 8. The selection of the individual cleaning steps is strongly dependent on the degree of contamination and on the required degree of cleanliness or the agents used.

The apparatus for carrying out the process is formed by a central tank 7 for cleaning liquids, which is provided with a filter, and by a high-pressure pump 8 which is connected to the tank via a line 6. By a continuation of the line 6, the high-pressure pump is connected to the connection piece(s) 5 of a kneader mixer 1. A further line 10 leads via a shut-off valve 11 to a spray lance 13. Another line 14 from the tank 7 leads via a shut-off valve 15 to a residue and effluent processing, which is not illustrated.

Figure 3:
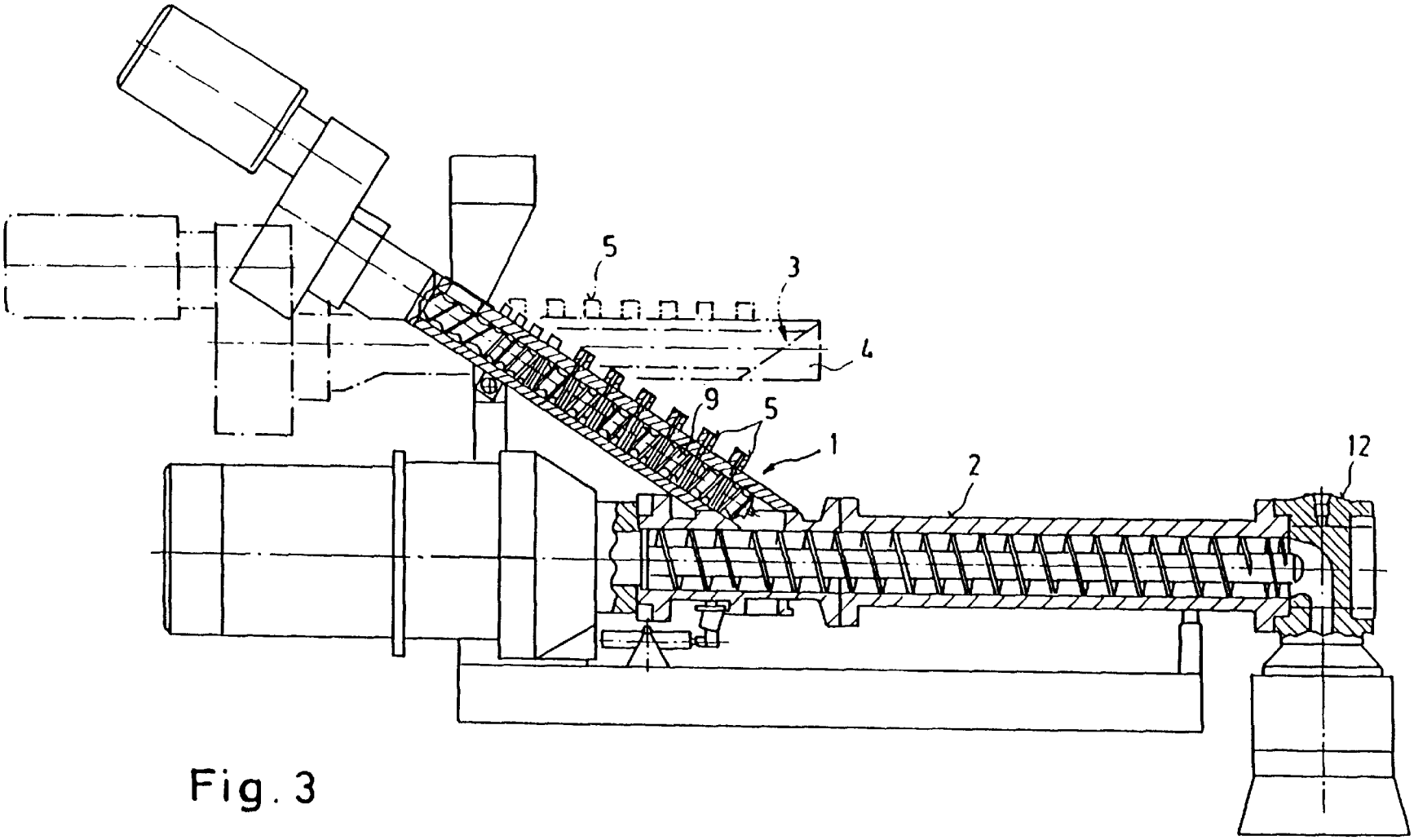
FIG. 3 an arrangement comprising a screw-type machine and a swivelling kneader mixer (double-shaft kneader).

A closure 4 seals the outlet opening 3 of the kneader mixer 1 when the latter is in its swung-out cleaning position (FIG. 3). The control of the course of the cleaning and of the apparatus is effected by means of a customary control unit, which is not illustrated.

Due to the arrangement of only one central tank, the cost of installation and control is reduced. Impairment of operation due to the action of different cleansing agents does not occur.

The invention is not restricted solely to this embodiment.

We claim:

1. An apparatus for cleaning pasta presses, by a treatment with water, lyes and acids, comprising:

a tank provided with a filter, connecting hydraulic lines, and a high-pressure pump connected to the tank, wherein the tank is connected by the lines to a screw-type machine to be cleaned via the high-pressure pump, the pump being operative to pump cleaning fluid in a forward direction;

a spray lance fitted to the screw-type machine, wherein the tank is connected by the lines to the spray lance, the tank connecting to an effluent treatment plant; and wherein the spray lance is operative to conduct the cleaning liquid in both said forward direction and in a reverse direction opposite to said forward direction, the cleaning liquid being filtered in the tank and recycled through the screw-type machine.

2. An apparatus according to claim 1, wherein the lines are provided with high-pressure spray nozzles for directing the cleaning liquid into the screw-type machine.

3. An apparatus according to claim 1, wherein the apparatus conducts the cleaning liquid into a screw press and/or a kneader mixer of the screw-type machine, the screw press and the kneader mixer being closed in liquid-tight manner, the apparatus discharging the cleaning liquid with adhering contaminants.

4. An apparatus for cleaning pasta presses by a treatment with cleaning liquid, comprising:

a tank provided with a filter, and connecting lines effecting a connection between the tank and a screw-type machine to be cleaned;

a spray lance fitted to the screw-type machine, wherein the tank is connected by the lines to the spray lance, the tank connecting to an effluent treatment plant; and wherein the spray lance conducts the cleaning liquid in both a forward direction towards the tank and in a reverse direction opposite to said forward direction.

5. An apparatus for cleaning a system of screw-type machines, by a treatment with cleaning liquid, the system being suitable for a pasta press, comprising:

a tank provided with a filter, and connecting lines effecting a connection between the tank and a first of the screw-type machines and a second of the screw-type machines;

a spray lance fitted to one of the screw-type machines wherein the tank is connected by the lines to the spray lance, the tank connecting to an outlet of the liquid; and wherein the apparatus conducts cleaning liquid via the lines into the first and the second of said screw-type machines for joint cleaning of the screw-type machines of the system.

6. An apparatus according to claim 5, wherein said lines conduct the cleaning fluid serially between the first and the second of the screw-type machines.

* * * * *